United States Patent [19]

Calhoun et al.

[11] Patent Number: 4,788,841

[45] Date of Patent: Dec. 6, 1988

[54] METHOD AND APPARATUS FOR MAKING STEP WALL TUBING

[75] Inventors: Jeffrey D. Calhoun; David A. Davis, both of Lafayette, Ind.

[73] Assignee: Aluminum Company of America, Pittsburgh, Pa.

[21] Appl. No.: 122,071

[22] Filed: Nov. 18, 1987

[51] Int. Cl.[4] ..... B21C 1/24

[52] U.S. Cl. ..... 72/22; 72/283

[58] Field of Search ..... 72/283, 276, 21, 22

[56] References Cited

U.S. PATENT DOCUMENTS

| | | | |
|---|---|---|---|
| 2,228,301 | 1/1941 | Ditzel et al. | 72/283 |
| 2,240,456 | 4/1941 | Darner | 72/283 |
| 2,258,242 | 10/1941 | Ditzel et al. | 72/276 |
| 2,679,925 | 6/1954 | McIlvried et al. | 72/283 |
| 3,169,635 | 2/1965 | Prindle | 72/283 |

FOREIGN PATENT DOCUMENTS

| | | | |
|---|---|---|---|
| 25812 | 12/1984 | Japan | 72/283 |

*Primary Examiner*—Daniel C. Crane

*Attorney, Agent, or Firm*—Elroy Strickland

[57] ABSTRACT

Apparatus and method for providing the wall of an elongated metal tube with a plurality of precisely located thick and thin wall portions lengthwise on the tube. The apparatus includes a drawing die having a relatively wide mouth, and a drawing bulb located in the tube to be drawn and for entering the die when the tube is pulled through the die. The bulb has a constant cross section and a relatively square nose. An actuator is provided for inserting the nose of the bulb into the mouth of the die to provide each thin wall portion and for withdrawing the nose from the die to provide each thick wall portion while drawing the tube. An electrical controller controls the actuator, and a distance measuring device outputs signals to the controller that are representative of precise increments of tube travel. The controller, in response to the signals, is effective to precisely control the occurrences of bulb insertion and withdrawal. The speed and accuracy of the apparatus make the step wall tube products cost competitive with traditional straight wall products while saving weight and raw material.

2 Claims, 1 Drawing Sheet

METHOD AND APPARATUS FOR MAKING STEP WALL TUBING

BACKGROUND OF THE INVENTION

The present invention relates generally to drawing metal tubes and particularly to apparatus and a method for providing precisely located thick and thin wall portions in elongated drawn tubes in an economical manner.

AA recent development employing step wall tubing is disclosed in a U.S. Pat. No. 4,527,978 to Zackrisson. In this patent, a yoke for a universal joint is welded in each end of a hollow tube, each end having a wall that is somewhat thicker than the wall intermediate the ends. The tube with the welded yokes provides a drive shaft for use in motor vehicles.

Automotive drive shafts are one of the many uses for long lengths of drawn tubing that have been provided with thick and thin wall portions. For example, such spaced apart thick wall portions along a tube length can provide structural areas for many types of fastening means when members need to be fastened to the tube. Further, such a tube can weigh less than a straight wall tube. Or, if a particular portion of the tube requires that its outer diameter be turned down (i.e. machined), the thickness of the tube wall can be controlled and maintained.

If thick wall portions are located internally of a long tube such that the thick portions are not externally visible to the untrained eye, the user of such tube lengths must be assured of the locations of the thick wall portions. If an indication of the location of the internal thickwall portions appears on the external surface of the tube, then personnel knowing what to look for will be able to locate the position of the thickwall wall portion. In the case of making short lengths of tube from long tube lengths by cutting the same into short lengths, such as the drive shafts of Zackrisson, the locations of the thick wall portions must be precisely known in order to position the cutting mechanism at the precise longitudinal center of each thick wall portion so that each end of the resulting tube section will have the same length of thick wall.

It is, therefore, an objective of the invention to precisely locate thick and thin wall portions along the lengths of drawn tubes.

A problem that has been encountered in making step wall tubing is the chattering of the drawing bulb in the mouth of the die when the bulb is inserted to provide the thin wall portions. Chattering is caused by a force component in the die mouth that resists seating the bulb while friction between the tube and bulb, as the tube moves through the die, attempts to seat the bulb in the die mouth. If the bulb does not immediately and properly seat in the mouth of the die and stay seated during the drawing process, the chattering bulb marks the internal surface of the tube with a series of rings and indentations. Such rings and indentations can function as stress risers to cause future weakness problems when the tube is used.

What is therefore needed in the industry and which forms another primary objective of the present invention is the provision of drawing apparatus that prevents bulb chattering and provides a smooth transition area between the thick and thin portions of the step wall tube.

Previous practice by the present inventors to make step wall drawn tube involved manually manipulating a standard drawbench by starting, stopping and reversing drawbench action. This resulted in a severe increase in cycle time over that for drawing a similar length of straight wall tube. For example, the cycle time for a single step tube was 200% greater than that of a straight wall tube, and 1500% greater for a 12 step tube. Further, accuracy at best was plus or minus 5 inches which resulted in 100% to 1000% increase in sawing time, as the locations of the thick and thin wall portions were uncertain, i.e., it was difficult to properly locate the tube relative to the saw. This resulted in 25% of the stepped sections to be unusable. In addition, such low accuracy prevented the repeatability from tube to tube needed for applications of multiple stepped products. Steps closer together than 18 inches could not be made with the manual method, which resulted in scrapping excess tube length and prevented fulfilling the market demand for short step tube and some multi-step tube.

It is therefore another objective of the invention to make step wall tube as economical or more economical than straight wall tubing, and to provide steps short enough to meet current market demands.

SUMMARY OF THE INVENTION

The present invention is directed to the discovery that a drawing die provided with a relatively wide mouth and employed with a relatively square nose drawing bulb of constant diameter decreased the component of the die force resisting the bulb much more than the frictional force existing between the tube and bulb such that the bulb is sucked into and firmly seated inside the constant internal diameter portion of the die when the bulb enters into the opening to provide a thin wall section during the drawing process. With such an action, there is no opportunity for the bulb to chatter in the die mouth. The consequence, as described in detail hereinafter, is an inside tube surface that is free of rings and marks, and a smooth transition area is effected between thick and thin tube wall portions formed in the tube that ensures the future integrity of the tube wall.

Without a shortening of the drawing surface (between die and bulb) and proper die angle, the die force resisting the bulb is greater than the opposing frictional force between the tube and the bulb to the degree that the die tries to reject the bulb against the force of an actuator attempting to insert the bulb. This results in oscillating (chattering) bulb movement in the die mouth. Such oscillation marks the tube in the manner described above.

The objective of precisely locating thick and thin wall portions along the tube length is effected by measuring small increments of tube travel as the tube is drawn through the die and, based upon such measuring, precisely timing the occurrence of bulb insertion and withdrawal in relation to the die mouth to form the thick and thin wall portions. This can be accomplished by use of a programmable controller receiving the information on tube travel distance, and electrically connected to operate an actuator. The actuator is mechanically connected to the rear of the drawing bulb to move the same into and out of the die mouth.

The objective of the invention to provide economically superior step wall tubing is accomplished by operating a drawbench at a rate sufficient to keep the drawing time for stepped wall tube at least as low as that of straight wall tube, if not less. This is accomplished by precisely locating the thick and thin wall portions such that all of the stepped sections are usable. In addition, sawing process time will be similar between stepped wall and straight wall tubes of the same length. Further, (1) more steps can be made on a particular length of the tube, (2) the steps can be made 600% shorter than with manual methods, and (3) multiple step tubes can be precisely and reliably made. The industry receives benefits of a product that weighs less at a cost usually less than straight wall tubing while maintaining the same structural strength and reliably located thick and thin wall portions, and conserving valuable raw materials.

BRIEF DESCRIPTION OF DRAWINGS

The invention, along with its objectives and advantages, will be best understood from the following detailed description and the accompanying drawing in which.

PREFERRED EMBODIMENT

Figure 1:
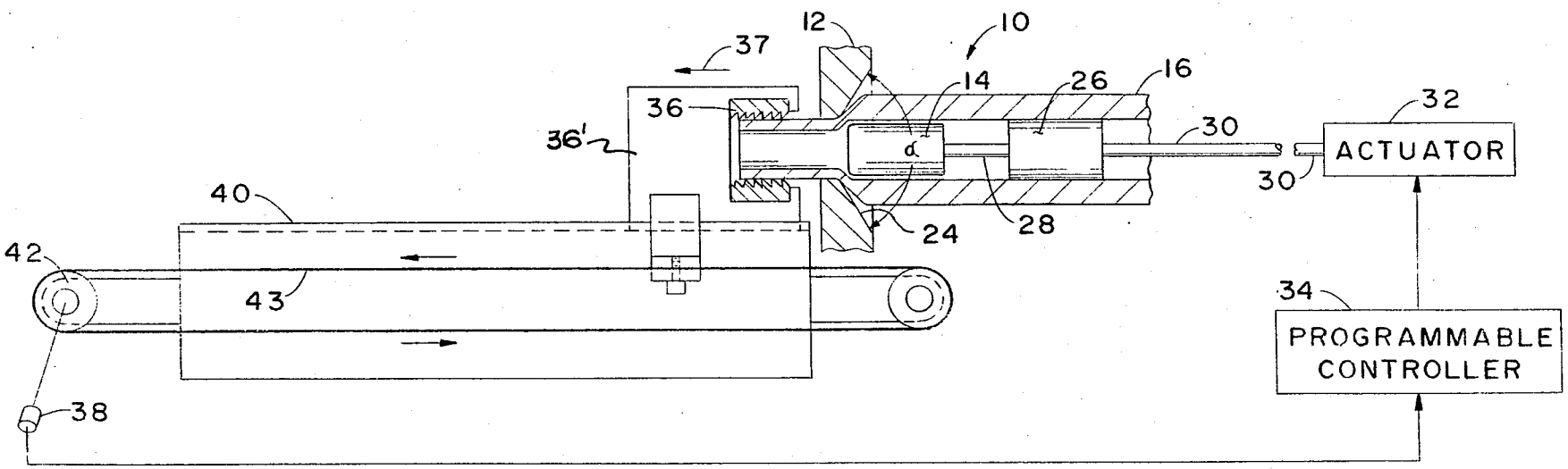
FIG. 1 is a partial sectional view of a drawing die and bulb arrangement of the invention and a schematic representation of additional apparatus of the invention for drawing a metal tube.
Figure 2:
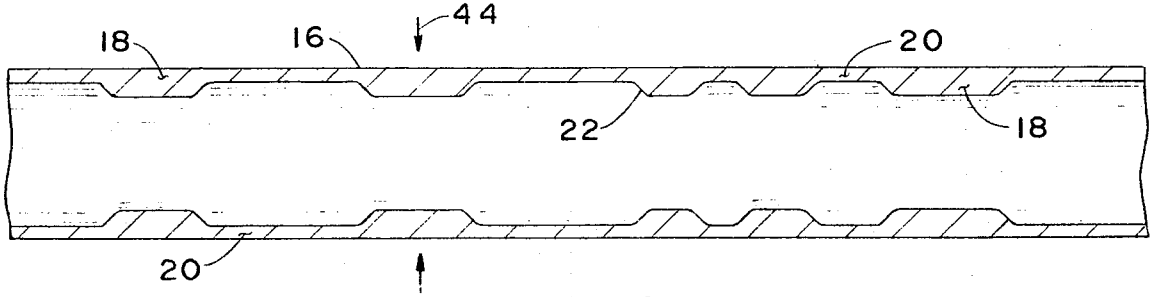
FIG. 2 is a partial longitudinal section of a tube drawn by the apparatus of FIG. 1.

Referring now to the drawing, FIG. 1 thereof shows a die and bulb arrangement 10 that is effective in forming long lengths of step wall tubing with smooth transitions between the steps. More particularly, FIG. 1 shows a drawing die 12 and a drawing bulb 14. The bulb is shown disposed in a metal tube 16 to be provided with precisely located thick wall portions 18 separated by precisely located thin wall portions 20, as shown in FIG. 2. Between the thick and thin wall portions of FIG. 2 are transition areas 22 that are smooth, i.e. that are free of circular marks, rings and indentations on the inner tube surface. The relative thicknesses of 18 and 20 in FIG. 2 are exaggerated for purposes of illustration.

Tube 16 can be any material ductile enough to be drawn. The tube is preferably predrawn from a bloom (not shown) of metal material, such as an alloy of aluminum suitable for the end use of the tube, to provide the tube with appropriate work hardening when necessary. For example, before heat treating of 6061 aluminum tube to provide the same with T6 temper, at least a twenty percent reduction of cross sectional area is considered a required minimum. Such reduction is provided by drawing a bloom through a die and over a bulb of appropriate size.

The mouth of die 12, as shown in FIG. 1, is provided with a wide angle, substantially cone-shaped opening 24, the angle of the cone being dependent upon the type of material to be drawn. Such an opening reduces the length of the bearing surface of die that contacts the outside surface of the tube, and thus reduces the drag on the tube, as it is being pulled through the die. The nose of the bulb 14, on the other hand, is relatively square such that its tube contacting surface is relatively short and sharp. The combination of the two, i.e. of the wide die mouth and square bulb nose, provide a short drawing and tube working distance. This provides frictional force relationships between the tube, the die and the bulb such that the die does not try to reject the bulb from the die mouth, as described earlier. And though the nose of the bulb is square, it is configured, i.e. rounded, to the extent it will not mark the internal surface of the tube and thereby cause stress risers in the tube wall. In addition, with a proper nose configuration, the leading and trailing edges of the thick wall portions 18, i.e., the transition areas 22, will be substantially identical.

As shown further in FIG. 1, bulb 14 is provided with a constant outside diameter. Such an outside diameter is helpful in maintaining square, proper orientation of the bulb in the die mouth. The entire inside surface of tube 16 travels over the bulb.

In addition, a mandrel 26 (FIG. 1) can be located at and connected to the rear of bulb 16 by a rod 28. The mandrel also has a constant outside diameter, and is preferably made of a durable, lightweight non-metallic material.

Mandrel 26 is particularly useful in drawing long lengths of tubing. As seen in FIG. 1, the mandrel and bulb are supported at one end of a long rod 30. Rod 30, because of its long length, bends under the weight of the bulb such that the bulb will rest heavily on the lower inside surface of the tube and hence tend to move from the axial center of die mouth 24. Mandrel 26 counteracts this tendency, as its constant diameter seats squarely in tube 16, and the short length of connecting rod 28 is sufficiently rigid to maintain the bulb in alignment with the die opening.

As seen in FIG. 1, the end of rod 30 remote from mandrel 26 is connected to a suitable actuating mechanism 32, hereinafter referred as an "actuator". If the actuator includes a fluid operated cylinder (not shown), rod 30, of course, will be mechanically connected to a piston located within the cylinder.

The cylinder of the actuator, under control of a suitable programmable electrical controller 34, receives and exhausts a suitable working fluid to insert and withdraw bulb 14 into and from the mouth 24 of die 12.

The operation of the apparatus depicted schematically in FIG. 1 is as follows. Tube 16 is slipped over bulb 14 (and mandrel 28 if used) and lengthwise along rod 30. The leading end of the tube is then threaded through die 12 and gripped by jaw means 36. 36 is a part of a movable carriage 36' diagrammatically shown in FIG. 1 mounted on an elongated draw bench 40 that is operative to pull the carriage and thus the entire length of the tube through die 12. As the tube is pulled through the die (in the direction of arrow 37 in FIG. 1), a rotary encoder 38 is provided to rotate with a pulley 42. Pulley 42 is rotated by a cable 43 connected to the carriage such that the output of encoder 38 is proportional to the travel distance of 36 to provide a precise linear measurement of the position of the tube relative to the location of die 12. The encoder does this by outputting a pulse for each small increment of distance traveled by the carriage. Controller 34 receives each pulse, counts the number of pulses received to determine the distance traveled, and orders the insertion and withdrawal of the bulb 14 by appropriate control of actuator 32.

More particularly, before the drawing process begins, the lengths desired for thin portions 20 and thick portions 18 to be provided in tube 16 are given to a workman attending the draw bench. This length data is entered by him into controller 34, or can be selected by him from data previously stored in the controller memory. Sink delay length and bulb-to-die depth are also provided. Critical to each diameter size tube is the delay employed in directing tube through the die before the first thickwall portion is formed, and the depth of the bulb in the die. These are determined experimentally.

The draw bench is now started and begins pulling the tube through die 12. Encoder 38 rotates proportionally to the travel of the tube and directs pulses to the controller. The controller is given a signal that the draw has begun and properly orients the bulb at a predetermined position at the mouth of the die. The controller begins to count the pulses sent from the encoder and at the proper amount of the tube travel, directs the actuator to fully insert the bulb into the die. This provides an interference fit between the bulb and the tube. The drawing surfaces of the bulb and die thin the material of the tube while the pulses are counted by the controller to provide a thin wall portion or section 20 (FIG. 2). When the number of pulses counted equals the length selected for the thin section, the controller orders actuator 32 to withdraw bulb 14 from die 12. The distance of the withdrawal stroke of the cylinder is only that needed to eliminate the interference fit of the bulb in the tube. The wall of the tube is now drawn down into the die by an amount that will provide the desired thickness for thick sections 18 of the tube. Controller 34 now counts the number of pulses as the thick wall is formed. When the count is reached that has been selected for the length of the thick wall section, the controller orders reinsertion of bulb 14 to provide the next thin section 20. This process occurs at the full line speed of the drawbench and continues until the desired number of steps are made in the tube. Any remaining portion of the tube will have a constant wall thickness of either thick or thin wall as preselected by the operator.

In the above manner, actuator 32 is operated to alternately insert bulb 14 into die mouth 24 and to withdraw the bulb under the precise control of controller 34 and encoder 38. This provides tube 16 with the precisely located thick and thin portions 18 and 20 along the length dimension of the tube. With such precise locations, the user of the tube can make effective use of thick and thin portions. As discussed earlier, if the thick portions are employed for fastening purposes, because of the increase in available tube material and structure, any fasteners, welds, slots, or holes can be centered thereon (see arrow 44 in FIG. 2) to provide a structurally sound connection.

Similarly, if tube 16 is to be cut into short lengths for the purpose of the above U.S. Pat. No. 4,527,978, for example, a mechanism (not shown) for cutting tube 16 is centered on each thick portion 18 (see again arrow 44) to cut the tube and thereby provide tube lengths having equal lengths of thick wall at the ends of the tube lengths.

Preferably, before tube 16 is provided with the thick and thin wall portions, as thus far described, the tube is drawn from a tube bloom (not shown) such that tube 16 is provided initially with a certain amount of cold working, if desired. In this manner, when the tube is drawn again to provide the thick and thin wall portions (18 and 20), further cold working is effected. This provides the final tube product with strength and toughness characteristics that are greater than those of the original drawn tube.

As discussed above, the short drawing distance provided by the square nose of bulb 14 and the wide mouth 24 of die 12 reduces, if not eliminating altogether, bulb chatter in the die mouth. The result is a smooth inside tube surface and smooth transition areas 22 extending between the thick and thin wall portions effected by the controlled movement of actuator 32. Such transition areas provide the tube with structural integrity, as there are no circular indentations and rings in the tube wall to form stress risers.

What is claimed is:

1. Apparatus for providing the wall of an elongated tube with a plurality of precisely located thick and thin wall portions lengthwise of the tube comprising:

a drawing die having a relatively wide mouth for receiving an end of a tube, a drawing bulb for insertion into the tube, said bulb having a constant cross-section and a relatively square nose for entering into the die mouth while being located within the tube, means for inserting the nose of the bulb with required precision and quickness into the mouth of the die to provide each thin wall portion and for withdrawing the nose from the die mouth to provide each thick wall portion while drawing the tube, a controller for controlling the means for inserting and withdrawing the bulb, means for pulling the tube through the die, and a rotary encoder for measuring distance increments of tube travel as the tube is pulled through the die, and for outputting signals that are representative of such increments said rotary encoder being connected to the controller such that the signals are directed to the controller, the controller, in response to the signals, being effective to precisely control the occurrence of bulb insertion and withdrawal.

2. A method of providing an elongated tube with relatively thick and thin wall portions, the method comprising the steps of providing a drawing bulb having a relatively square nose and constant cross section, disposing the bulb in an elongated tube, disposing an end of the tube in the mouth of a drawing die, providing the mouth with a wide opening and a relatively short bearing surface, pulling the tube through the die and over the bulb, using a rotary encoder to measure incremental distances of tube travel, and alternately locating the nose of the bulb in and withdrawing the same from the mouth of the die in response to measurements of tube travel distances such that alternately spaced apart relatively thick and thin wall portions are formed in the tube at precise locations lengthwise of the tube.

* * * * *